US005323537A

United States Patent [19]

Ohori

[11] Patent Number: 5,323,537

[45] Date of Patent: Jun. 28, 1994

[54] COVER FOR A NAIL CLIPPER

[76] Inventor: Hiroshi D. Ohori, P.O. Box W, Cedar Knolls, N.J. 07927

[21] Appl. No.: 930,160

[22] Filed: Aug. 14, 1992

[51] Int. Cl.[5] ..... A45D 29/00; A45D 29/04

[52] U.S. Cl. ..... 30/28; 132/75.6

[58] Field of Search ..... 30/28; 132/75.6, 75.4, 132/73

[56] References Cited

U.S. PATENT DOCUMENTS

| | | | |
|---|---|---|---|
| 3,722,518 | 3/1973 | Fravel | 132/75.6 |
| 3,855,698 | 12/1974 | Crosby | 132/75.4 |
| 3,943,948 | 3/1976 | Sartore | 30/28 |
| 4,150,481 | 4/1979 | Min | 30/28 |
| 4,219,929 | 9/1980 | Min | 30/28 |
| 4,574,475 | 3/1986 | Lee | 30/28 |
| 4,776,090 | 10/1988 | Grassi | 30/28 |
| 5,031,765 | 7/1991 | Chen | 30/28 |
| 5,046,606 | 9/1991 | Morelli | 30/28 |

*Primary Examiner*—Richard K. Seidel
*Assistant Examiner*—Paul M. Heyrana, Sr.
*Attorney, Agent, or Firm*—Francis C. Hand

[57] ABSTRACT

The cover for a nail clipper is made of plastic and is mounted over the cutting end of the nail clipper. The cover is movable from a position shielding the jaws of the nail clipper to a position permitting access to the jaws of the nail clipper. The cover includes a front wall to shield the jaws in the first position and an opening to provide access to the jaws of the second position. Shoulders are provided on the upper ends of the side walls to define a stop for abutting the nail clipper in the second position.

20 Claims, 1 Drawing Sheet

Fig. 1
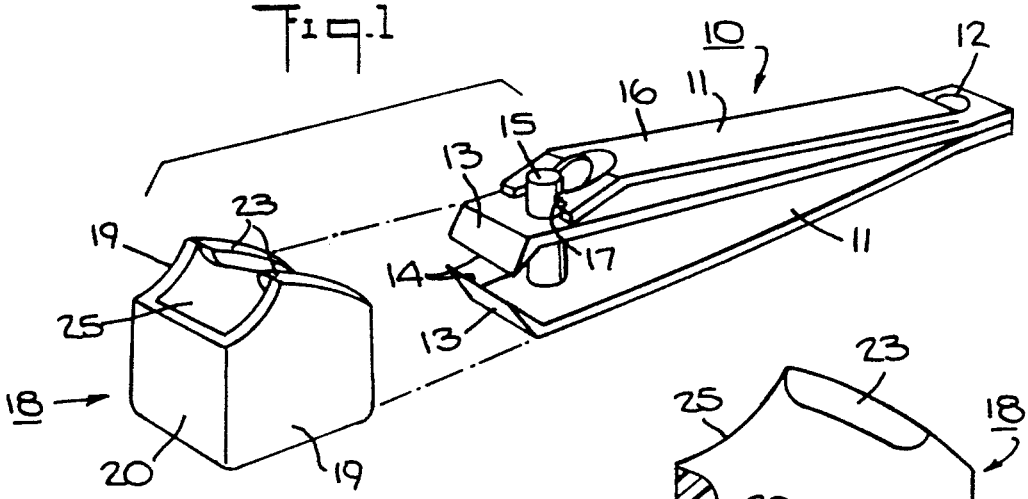
Fig. 2.
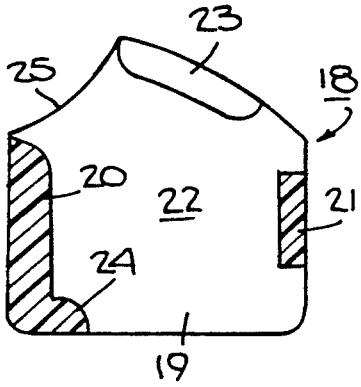
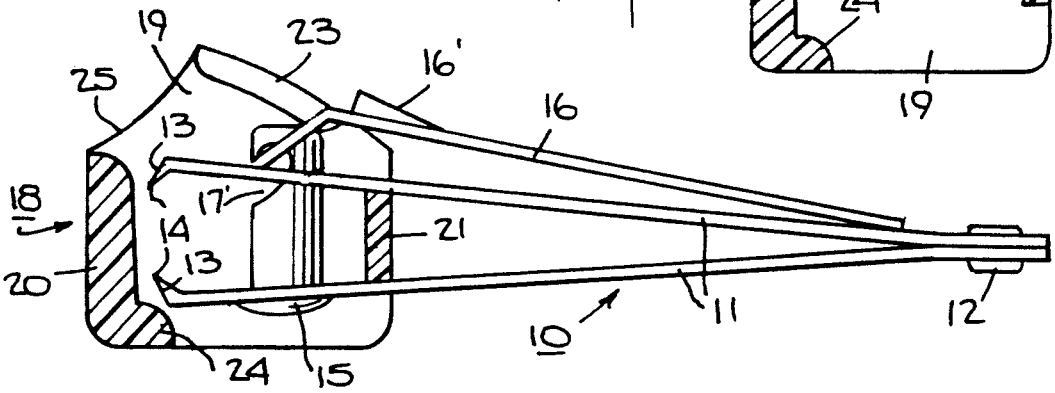
Fig. 3.
Fig. 4.
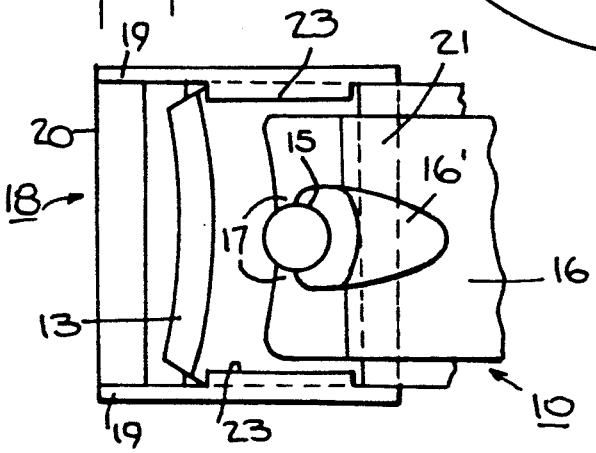
Fig. 5.
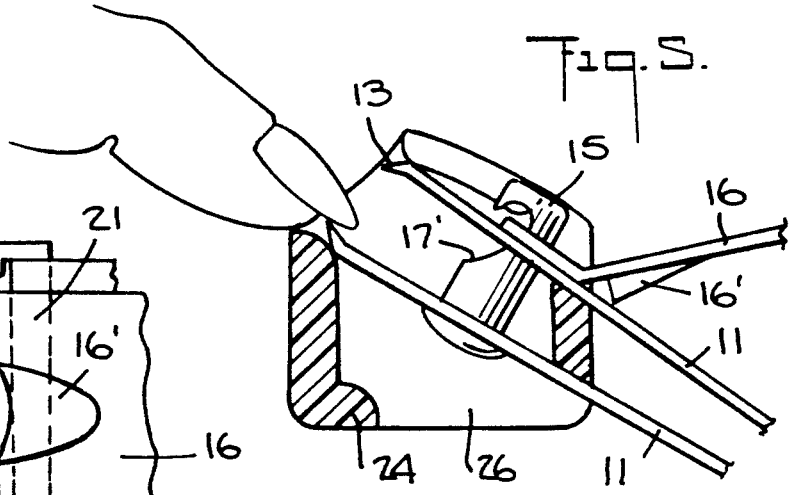

COVER FOR A NAIL CLIPPER

This invention relates to a cover for a nail clipper.

As is known, various types of nail clippers have been constructed with guards to prevent accidental cuts from sharp edges. Typically, such nail clippers include a pair of elongated bars which are secured together at one end and which carry sharp jaws at the opposite end for the clipping of nails. When exposed, the sharp jaws may inadvertently cut or nick the skin of a person handling the nail clipper. In addition, if placed in a pocket or purse in an unexposed condition, the sharp jaws may damage other articles in the pocket or purse. Accordingly, various attempts have been made to provide covers or guards or such nail clippers, for example, as described in U.S. Pat. No. 4,788,768.

However, the various attempts to provide a shield or cover over the sharp jaws of a nail clipper have been rather cumbersome or require relatively complex manufacturing and/or assembling techniques.

Accordingly, it is an object of the invention to provide a cover for a nail clipper of relatively simple construction.

It is another object of the invention to provide a cover for a nail clipper which can be readily mounted on a nail clipper during assembly.

It is another object of the invention to provide a cover of relatively compact construction for mounting over the cutting end of a nail clipper.

Briefly, the invention provides a cover which can be disposed over one end of a nail clipper to enclose a pair of cutting jaws at the end of the nail clipper.

The cover is constructed with a pair of side walls disposed in spaced apart relation, a front wall connecting the side walls together and a rear wall connecting the side walls together and disposed opposite the front wall to define a hollow space for receiving the forward cutting end of the nail clipper. The cover also has a pair of shoulders, each of which is disposed on an upper end of a respective side wall to project into the space between the side walls to define a stop for abutting the forward end of the nail clipper disposed therein.

The cover is particularly constructed to cooperate with a nail clipper having a pair of elongated bars secured together at one end with each bar having a jaw at an opposite end in facing relation to a jaw on the other bar as well as means for moving the jaws relative to each other. In this embodiment, the cover is connected to the nail clipper to move between a first position shielding the jaws and a second position exposing the jaws for use.

When the cover is in the first position, the front wall faces the jaws of the nail clipper. In addition, the cover has an opening above the front wall for alignment with the jaws in the second position of the cover to provide access to the jaws. The cover also has a second opening at the bottom for expelling nail clippings from within the cover after the nail clipper has been put to use.

The nail clipper may be constructed with a post secured to one of the bars and passing through the other of the bars. In this embodiment, the rear wall of the cover is disposed between the bars on the side of the post remote from the front wall in order to maintain the cover on the nail clipper. In this respect, the rear wall is of less height than the front wall.

In addition to the shoulders on the sidewalls which define a stop for abutting one of the bars of the nail clipper in the second position of the cover, the front wall has a shoulder at a lower end which projects towards the rear wall in order to define a stop for abutting the other bar of the nail clipper in the first position of the nail clipper.

The cover may be made of any suitable material; however, a plastic is a preferred material for example for purposes of economy and for softness of material to avoid sharp edges.

These and other objects and advantages of the invention will become more apparent from the following detailed description taken in conjunction with the accompanying drawings wherein:

FIG. 1 illustrates an exploded view of a nail clipper and cover constructed in accordance with the invention;

FIG. 2 illustrates a cross-sectional side view of the cover of FIG. 1 in accordance with the invention;

FIG. 3 illustrates a partial cross-sectional side view of the cover and nail clipper of FIG. 1;

FIG. 4 illustrates a top view of the cover with a part of the nail clipper disposed therein; and FIG. 5 illustrates a part cross-sectional view of the cover with the nail clipper in a position of use relative to a fingernail.

Referring to FIG. 1, the nail clipper 10 is constructed in a conventional manner and need not be described in detail. For example, the nail clipper 10 includes a pair of elongated bars 11, each of which is secured to the other at one end as by a rivet 12. In addition, each bar 11 has a jaw 13 at an opposite end disposed in spaced facing relation to a jaw 13 on the other bar 11. Each jaw 13 carries a sharp edge 14 which is suitably shaped and sized for the clipping of nails.

As indicated, the nail clipper 10 includes a post 15 which is secured to the lower bar 11 in rotatable manner and which passes through the upper bar 11 as well as means for moving the jaws 11 relative to each other. This means is in the form of an actuating arm 16 which is pivotally mounted on the post 15 via a bar 17 which is received in a notch 17 in the post 15. In this respect, the actuating arm 16 can be moved from the position shown in FIGS. 1 and 3 into a position as shown in FIG. 5 for moving the bars 11 together in a conventional manner via a cam 16. As indicated, the actuating arm 16 is bent to effect the pivoting action of the bars 11.

Referring to FIG. 1, a one piece cover 18 is connected to the nail clipper 10 and is disposed over one end of the nail clipper 10 to enclose the jaws 13 therein. The cover 18 is made of any suitable material, for example, a plastic material.

The cover 18 includes a pair of side walls 19 which are disposed in spaced apart relation, a front wall 20 which connects the side walls 19 together, and a rear wall 21 (see FIG. 2) which connects the side walls 19 together and which is disposed opposite the front wall 20 to define a hollow space 22 (see FIG. 2) therebetween for receiving the forward end of the nail clipper 10 (see FIG. 3).

The cover 18 also has a pair of shoulders 23, each of which is disposed on an upper end of a respective side wall 19. Each shoulder 23 projects into the space between the side walls 19 in order to define a stop for abutting the forward end of the nail clipper 10 as indicated in FIG. 5.

Referring to FIG. 2, the front wall 20 carries a shoulder 24 which projects into the internal space of the cover 18 towards the rear wall 21 in order to define a stop for abutting the forward end of the nail clipper 10 as indicated in FIG. 3

Referring to FIG. 3, the cover 18 is assembled with the nail clipper 10 so as to be permanently connected with the nail clipper 10 while being disposed over the end of the nail clipper 10 to enclose the jaws 13 therein. As indicated, the cover 18 is movably mounted on the nail clipper 10 to move between a first position shielding the jaws 13 as indicated in FIG. 3 and a second position exposing the jaws as indicated in FIG. 5. To this end, the cover 18 has an opening 25 above the front wall 20 for alignment with the jaws 13 in the position shown in FIG. 5 in order to provide access to the jaws 13.

The cover 18 also has a second opening 26 in a bottom thereof through which nail clippings can be expelled from within the cover when the clipper 10 is in use.

As indicated in FIG. 3, the rear wall 21 of the cover 18 is of less height than the front wall 20 for disposition between the elongated bars 11 of the nail clipper. In addition, the rear wall 21 is disposed on a side of the post 15 which is remote from the front wall 20. As indicated in FIG. 5, the rear wall 21 is sized and shaped so as not to interfere with the bringing together of the cutting jaws 14 or m y be sufficiently soft and resilient to compress under the compressing force imposed by the actuating arm 16 via the bars 11.

By way of example, during assembly, prior to insertion of the post 15 into the bars 11, the cover 18 can be slid over the end of the bars 11 with the rear wall 21 disposed between the bars 11. Thereafter, the post 15 can be passed upwardly, as viewed in FIG. 3 through the lower bar 11 past the rear wall 21 and through the upper bar 11. The actuating arm 16 can then be mounted on the upper end of the post 15 to secure the components together.

As indicated in FIG. 4, the shoulders 23 on the side walls 19 of the cover are spaced apart a distance sufficient to permit passage of the actuating arm 16 from the position shown in FIG. 3 to the position shown in FIG. 5.

In use, the cover 18 is mounted on the nail clipper 10 in a position to have the front wall 20 shield the jaws 13, for example as shown in FIG. 3. In this position, the nail clipper 10 and cover 18 may be readily carried in a pocket, purse, on a key chain, and in other conventional manners. Further, this shielded position can be maintained by having the side walls 19 contact the sides of the clipper bars 11 in a friction fit manner. That is, the side walls 19 are spaced apart a distance equal to or slightly less than the width of the clipper bars 11.

When one desires to use the nail clipper 10, the cover 18 is pivoted from the position shown in FIG. 3 to the position shown in FIG. 5 relative to the cover 18. In this position, the jaws 13 of the nail clipper 10 are exposed through the opening 25 of the cover 18. The jaws 13 may then be manipulated so as to cut a nail 27, such as on a finger 28 of a person. In this respect, the jaws 13 are slightly recessed within the cover 18 so that the sharp cutting edges 14 do not project outwardly of the cover 18. The nail clippings which are subsequently made can then be passed through the opening 26 in the bottom of the cover 18.

Alternatively, if one desires, the cover 18 instead of being made skeletal as shown, may be provided with a limited opening 26 in the bottom so that nail clippings may be accumulated within the interior space of the cover 18. In this respect, the opening would be sufficient so as to permit passage of the post 15 through the bars 11 during assembly. Still further, the opening may be plugged after assembling of the cover 18 on the nail clipper 10 so as to close off the bottom of the cover 18.

Various modifications may be made in the construction of the cover 18, such as in the shape, thickness and spacings of the various walls 19, 20, 21 to facilitate encapsulation of the cutting end of the nail clipper 10 and manipulation of the cover into the unshielded position to expose the cutting end for use. For example, the rear wall 21 should be wide enough to seal off any chips from entering the rear and thin enough to compress as the nail clipper closes.

The invention thus provides a cover of relatively simple compact construction which can be readily mounted on the cutting end of the nail clipper. Further, the invention provides a cover which can be readily manipulated from a position shielding the cutting jaws of the nail clipper to a position to permit access to the cutting jaws of the nail clipper.

What is claimed is:

1. A cover for a nail clipper comprising a pair of side walls disposed in spaced apart relation;

a front wall connecting said side walls together;

a rear wall connecting said side walls together and being disposed opposite said front wall to define a hollow space therebetween for receiving a forward end of a nail clipper therein; and a pair of shoulders, each shoulder being disposed on an upper end of each respective side wall and projecting into said space to define a stop for abutting the forward end of a nail clipper disposed therein.

2. A cover as set forth in claim 1 wherein each said wall is made of plastic.

3. A cover as set forth in claim 1 wherein said rear wall is of less height than said front wall for disposition between a pair of elongated bars of a nail clipper.

4. A cover as set forth in claim 1 wherein said front wall has a shoulder projecting into said space towards said rear wall to define a stop for abutting the forward end of a nail clipper disposed in said space.

5. In combination a nail clipper having a pair of elongated bars secured together at one end thereof, each bar having a jaw at an opposite end in facing relation to a jaw on the other of said bars, and means for moving said jaws relative to each other; and a cover connected to said nail clipper and disposed over one end of said nail clipper to enclose said jaws therein, said cover being movably mounted on said nail clipper between a first position shielding said jaws and a second position exposing said jaws.

6. The combination as set forth in claim 5 wherein said cover is permanently connected to said nail clipper and has a front wall facing said jaws in said first position of said cover and an opening above said front wall for alignment with said jaws in said second position of said cover to provide access to said jaws.

7. The combination as set forth in claim 6 wherein said cover has a second opening in a bottom thereof for expelling of nail clippings from within said cover.

8. The combination as set forth in claim 6 wherein said nail clipper has a post secured to one of said bars and passing through the other of said bars and said cover has a rear wall disposed between said bars on a side of said post remote from said front wall to maintain said cover on said nail clipper.

9. The combination as set forth in claim 8 wherein said rear wall is of less height than said front wall.

10. The combination as set forth in claim 6 wherein said cover has a pair of side walls disposed in spaced apart relation to each other with said front wall connecting said side walls together, said side walls being disposed on opposite sides of said nail clipper.

11. The combination as set forth in claim 10 wherein at least one of said side walls has a shoulder on an upper end thereof projecting towards the other of said side walls to define a stop for abutting one of said bars of said nail clipper in said second position.

12. The combination as set forth in claim 11 wherein said front wall has a shoulder at a lower end projecting towards said rear wall to define a stop for abutting the other of said bars in said first position.

13. The combination as set forth in claim 5 wherein said cover is made of plastic.

14. The combination as set forth n claim 5 wherein said cover has a pair of side walls, a front wall connecting said side walls and facing said jaws in said first position of said cover, a rear wall connecting said side walls together and being disposed between said bars in spaced relation to said front wall to define a space therebetween for receiving said jaws therein, and a pair of shoulders, each shoulder being disposed on an upper end of a respective side wall and projecting into said space to define a stop for abutting one of said bars in said second position.

15. The combination as set forth in claim 14 wherein said front wall has a shoulder projecting into said space to define a stop for abutting the other of said bars in said first position.

16. In combination a nail clipper having a pair of elongated bars secured together at one end thereof, each bar having a jaw at an opposite end in facing relation to a jaw on the other of said bars, and means for moving said jaws relative to each other; and a cover mounted on one end of said nail clipper to enclose said jaws therein, said cover being movably mounted on said nail clipper between a first position shielding said jaws and a second position exposing said jaws.

17. The combination as set forth in claim 16 wherein said cover has a front wall facing said jaws in said first position of said cover and an opening above said front wall for alignment with said jaws in said second position of said cover to provide access to said jaws.

18. The combination as set forth in claim 17 wherein said cover has a second opening in a bottom thereof for expelling of nail clippings from within said cover.

19. The combination as set forth in claim 17 wherein said nail clipper has a post secured to one of said bars and passing through the other of said bars and said cover has a rear wall disposed between said bars on a side of said post remote from said front wall to maintain said cover on said nail clipper.

20. The combination as set forth in claim 19 wherein said rear wall is of less height than said front wall.

* * * * *